US007350759B1

(12) United States Patent
Gray

(10) Patent No.: US 7,350,759 B1
(45) Date of Patent: Apr. 1, 2008

(54) QUICK RELEASE MOUNTING FOR A ROOM AIR CONDITIONER

(76) Inventor: Robert R. Gray, 502 S. Post Oak La., Suite 10, Houston, TX (US) 77056

( * ) Notice: Subject to any disclaimer, the term of this patent is extended or adjusted under 35 U.S.C. 154(b) by 0 days.

(21) Appl. No.: 11/218,682

(22) Filed: Sep. 1, 2005

Related U.S. Application Data

(60) Provisional application No. 60/605,880, filed on Sep. 1, 2004.

(51) Int. Cl.
*F16M 1/00* (2006.01)

(52) U.S. Cl. ..... 248/644; 454/204

(58) Field of Classification Search ..... 248/505, 248/644, 200.1, 208, 214, 274.1, 288.51, 248/295.11, 297.31; 403/49, 167, 324, 109; 454/196, 204; 62/262
See application file for complete search history.

(56) References Cited

U.S. PATENT DOCUMENTS 1,756,716 A * 4/1930 Whitney ..... 211/123
2,247,024 A * 6/1941 Hurley ..... 52/632
2,474,513 A * 6/1949 Behrens ..... 224/482
2,674,430 A * 4/1954 Galazzi et al. ..... 248/236
2,702,175 A * 2/1955 Hanin ..... 454/203
2,717,139 A * 9/1955 Jewell ..... 248/208
2,814,244 A * 11/1957 Hord ..... 454/203
2,895,688 A * 7/1959 Lidsky ..... 248/208
2,945,358 A * 7/1960 MacLeod et al. ..... 62/262
2,946,274 A * 7/1960 Grimes, Jr. ..... 454/203
2,998,711 A * 9/1961 Komroff ..... 62/262
3,030,873 A * 4/1962 Metcalfe ..... 454/204
3,134,319 A * 5/1964 Marsteller ..... 454/203
3,273,843 A * 9/1966 Bell, Jr. et al. ..... 248/208
3,306,181 A * 2/1967 Woods ..... 454/203
3,476,034 A * 11/1969 Ulich ..... 454/203
3,481,264 A * 12/1969 Ulich ..... 454/203
3,491,549 A * 1/1970 Oglesby ..... 62/262
3,548,611 A * 12/1970 Ulich ..... 62/262
3,552,470 A * 1/1971 Metcalfe ..... 160/26
3,554,476 A * 1/1971 Gaylor, Jr. ..... 248/208
4,118,902 A * 10/1978 Saxton ..... 52/27
4,243,342 A * 1/1981 Marto ..... 403/324
4,651,959 A * 3/1987 Bolton et al. ..... 248/208
5,050,831 A * 9/1991 Joyal ..... 248/208
5,167,131 A 12/1992 Karkhanis
5,346,036 A * 9/1994 Arisman et al. ..... 182/3
5,407,164 A * 4/1995 Quinn ..... 248/316.7
5,582,025 A 12/1996 Dubin et al.
5,636,816 A 6/1997 Burton et al.
5,934,631 A * 8/1999 Becker et al. ..... 248/200.1
5,967,478 A * 10/1999 Tynes ..... 248/241

(Continued)

*Primary Examiner*—Carl D. Friedman
*Assistant Examiner*—Bradley H Duckworth
(74) *Attorney, Agent, or Firm*—Kenneth A. Roddy

(57) ABSTRACT

A quick release mounting apparatus and method for mounting a room air conditioner in a window opening that utilizes a quick release mounting which supports the weight of the outdoor portion of the air conditioner in a cantilevered condition and, in the event of an emergency, upon releasing a latch mechanism allows the air conditioner to topple rearwardly from the window opening exterior of the room to provide an escape route through the open window. A safety harness may also be provided that suspends the air conditioner unit a distance above the ground on the exterior of the room after it has been released to prevent it from falling to the ground.

4 Claims, 5 Drawing Sheets

U.S. PATENT DOCUMENTS 6,032,916 A * 3/2000 Holliday ..... 248/505
6,173,930 B1 * 1/2001 Arbucci ..... 248/208
6,371,422 B1 * 4/2002 St. Martin et al. ..... 238/200.1
6,767,278 B1 * 7/2004 Peterson ..... 454/196
2006/0223434 A1 * 10/2006 Barker ..... 454/203

* cited by examiner

QUICK RELEASE MOUNTING FOR A ROOM AIR CONDITIONER

CROSS REFERENCE TO RELATED APPLICATION

This application claims priority of U.S. Provisional Patent Application Ser. No. 60/605,880 filed Sep. 1, 2004.

BACKGROUND OF THE INVENTION

1. Field of the Invention

This invention relates generally to room air conditioner mountings and, more particularly, to a method and apparatus for mounting a room air conditioner in a window opening utilizing a quick release mounting that supports the weight of the outdoor portion of the air conditioner in a cantilevered condition, and in the event of an emergency, upon releasing a latch mechanism allows the air conditioner to topple rearwardly from the window opening exterior of the room to provide an escape route through the open window.

2. Background Art

The typical room air conditioner comprises an outdoor portion and an indoor portion, the outdoor portion being in heat exchange relationship with the outdoor air, and the indoor portion being in heat exchange relationship with the indoor air. The conventional mounting technique is to mount the air conditioning unit in an existing window opening, with the heavy outdoor portion of the air conditioning unit supported on various types of supporting shelves, brackets, clamps, and the like to provide support and to securely fasten the air conditioning unit within the window opening from the exterior of the building. After the unit is supported on the window sill by the exterior support structure, the window sash is engaged on its upper surface, typically behind an upstanding lip or channel that extends transversely across the top surface of the cabinet near its front end. The upstanding lip or channel is also commonly referred to as a guide rail, top rail, or a top mounting rail. Suitable weather seals are also typically provided around the housing between the unit and the sash of the window and size adjustable filler panels or accordion-type side curtains are used at the sides of the unit in order to accommodate the various sizes of window openings.

Typically the air conditioning unit remains in the installed position except for removal as required for repair, maintenance or replacement. The removal process usually involves a substantial amount of time, tools and labor. The conventional mounting technique may also allow the window sash to be raised or lowered, however, the air conditioning unit still remains secured in the window opening.

Thus, in an emergency situation, such as a fire, the conventional mounting technique presents a serious safety hazard, especially if the window in which the air conditioning unit is mounted is the only means of escape; a situation similar to having burglar bars installed on the window.

There are several patents that disclose various apparatus and methods for mounting an air conditioner in a window opening, some of which may also allow the window sash to be raised or lowered, however, the air conditioning unit remains secured in the window opening.

Peterson, U.S. Pat. No. 6,767,278 discloses a window mounted air conditioner installation system that secures an air conditioner in a window opening while allowing a user to open and close the window. The system of apparatus includes; base plate which is mounted on the window sash and has central section, an inverted U-shaped indoor section, and an inverted L-shaped for supporting the air conditioner thereupon; and a two-piece telescoping support bar having a hollow rectangular first bar member and a rectangular second bar member slidably mounted therein with elastomeric end stoppers at the outer ends of the bars. The support bar is extended such that the end stoppers fit into the vertical side supports of the window frame in which the vertical sides of the window slide and is locked into the extended position on top of the air conditioner by a cam lever type locking member on the support bar.

Burton et al, U.S. Pat. No. 5,636,816 discloses a universal air conditioner mounting bracket for supporting a window air conditioner on a window sill in a window opening. The bracket includes: a generally horizontal support member attached to the window sill for supporting the outside portion of the air conditioner; a foot that rests against an outside surface of the wall below the window opening; a strut member having an upper end attached near a distal end of the support member and a lower end thereof attached to the foot member; and apparatus to selectively adjust height of the proximal end of the support member above the window sill.

Dubin et al, U.S. Pat. No. 5,582,025 discloses a low obstruction window air conditioner having a platform on an outer member of a window sill straddling bracket which can be raised and lowered by a jack screw. The air conditioner unit has an outer portion containing the compressor, the condenser coil, the fan (driven by a motor) and a condensate pump. Once in position, the inner unit is suspended from a pair of bars inserted through the bracket into the outer unit.

Karkhanis, U.S. Pat. No. 5,167,131 discloses a saddle type room air conditioning unit wherein evaporator and condenser housings are supported in a fixed relationship by a connecting portion affording support for the housings and controlled air flow communication between the housings. Sealing devices are releasably latched to the connecting portion and cooperate therewith to completely seal the unit vertically relative to a window sill and sash and horizontally between vertical sides of a window frame. A latching device is also disclosed for adjustably releasably latching upper and lower window sashes relative to one another, as required to prevent unauthorized removal of the unit from a window opening.

The present invention is distinguished over the prior art, and these patents in particular, by a quick release mounting apparatus and method for mounting a room air conditioner in a window opening that utilizes a quick release mounting which supports the weight of the outdoor portion of the air conditioner in a cantilevered condition and, in the event of an emergency, upon releasing a latch mechanism allows the air conditioner to topple rearwardly from the window opening exterior of the room to provide an escape route through the open window. A safety harness may also be provided that suspends the air conditioner unit a distance above the ground on the exterior of the room after it has been released to prevent it from falling to the ground.

SUMMARY OF THE INVENTION

It is therefore an object of the present invention to provide an improved method and apparatus for installing room air conditioners in a window opening.

It is another object of this invention to provide a method and apparatus for installing room air conditioners that will allow the air conditioner to topple from the window opening in the event of an emergency and permit occupants to escape through the opening.

Another object of this invention is to provide a method and apparatus for installing room air conditioners that will allow the air conditioner to topple from the window opening in the event of an emergency and suspend the air conditioner unit a distance above the ground on the exterior of the room after it has been released to prevent it from falling to the ground and provide an escape route through the open window.

Another object of this invention is to provide an improved method and apparatus for installing room air conditioners that has a quick release mounting that allows the air conditioner to be easily and quickly released from a window opening and permit occupants to escape through the opening in the event of an emergency.

A further object of this invention is to provide a quick release mounting technique and apparatus for installing room air conditioners in a window, which is simple and easy to implement.

A still further object of this invention is to provide a quick release mounting technique and apparatus for installing room air conditioners in a window which is simple in construction, inexpensive to manufacture, and rugged and reliable in operation.

Other objects of the invention will become apparent from time to time throughout the specification and claims as hereinafter related.

The above noted objects and other objects of the invention are accomplished by a quick release mounting for room air conditioners comprising an elongate support crossbar adapted to transversely span the distance between vertical side members of the window opening on the interior of the building with each end engaged on the side members. A securing bracket is slidably received through a slot in the crossbar and has a rear end configured to engage an upstanding lip or guide rail extending transversely across the upper surface of the air conditioning unit and receive the window sash, and has a tongue portion at a front end protruding from the crossbar with a slot therethrough. A quick release latch member having a tang portion installed through the slot in the tongue portion of the bracket releasably holds the bracket in place.

The air conditioning unit is placed on the window sill with the crossbar supported on its top surface and its outer ends on the sides of the opening. The rear end of the securing bracket is engaged over the lip of the guide rail on the upper surface of the air conditioning unit and its tongue portion extending through the crossbar. The window sash is brought down on the securing bracket to engage the bracket over the lip or guide rail, and the latch member is installed through the tongue of the bracket to secure the unit in its installed position. Size adjustable filler panels may be used at the sides of the air conditioning unit to accommodate the various sizes of window openings. The heavier outdoor portion of the air conditioning unit is exterior of the building in heat exchange relation with the outdoor air, and the lighter weight indoor portion is in heat exchange relation with the indoor air. The air conditioning unit is held in its installed position with its heavier weight outdoor portion cantilevered exterior of the building forming a rearward moment arm or rotational force that biases the crossbar into engagement with the vertical side members of the window opening on the interior of the building to support the weight of the unit. The air conditioning unit is thus supported from inside the room and, in the latched condition, allows the window to be raised and lowered.

In the event of an emergency, such as a fire, the occupant simply raises the window and withdraws the latch member from the tongue of the bracket. This causes the cantilevered weight of the air conditioning unit to pull the securing bracket rearwardly from the crossbar thereby relieving the force holding the crossbar against the window frame. The air conditioning unit will then topple rearwardly from the window opening exterior of the room to provide an escape route through the open window. A safety harness may also be provided that suspends the air conditioner unit a distance above the ground on the exterior of the room after it has been released to prevent it from falling to the ground.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
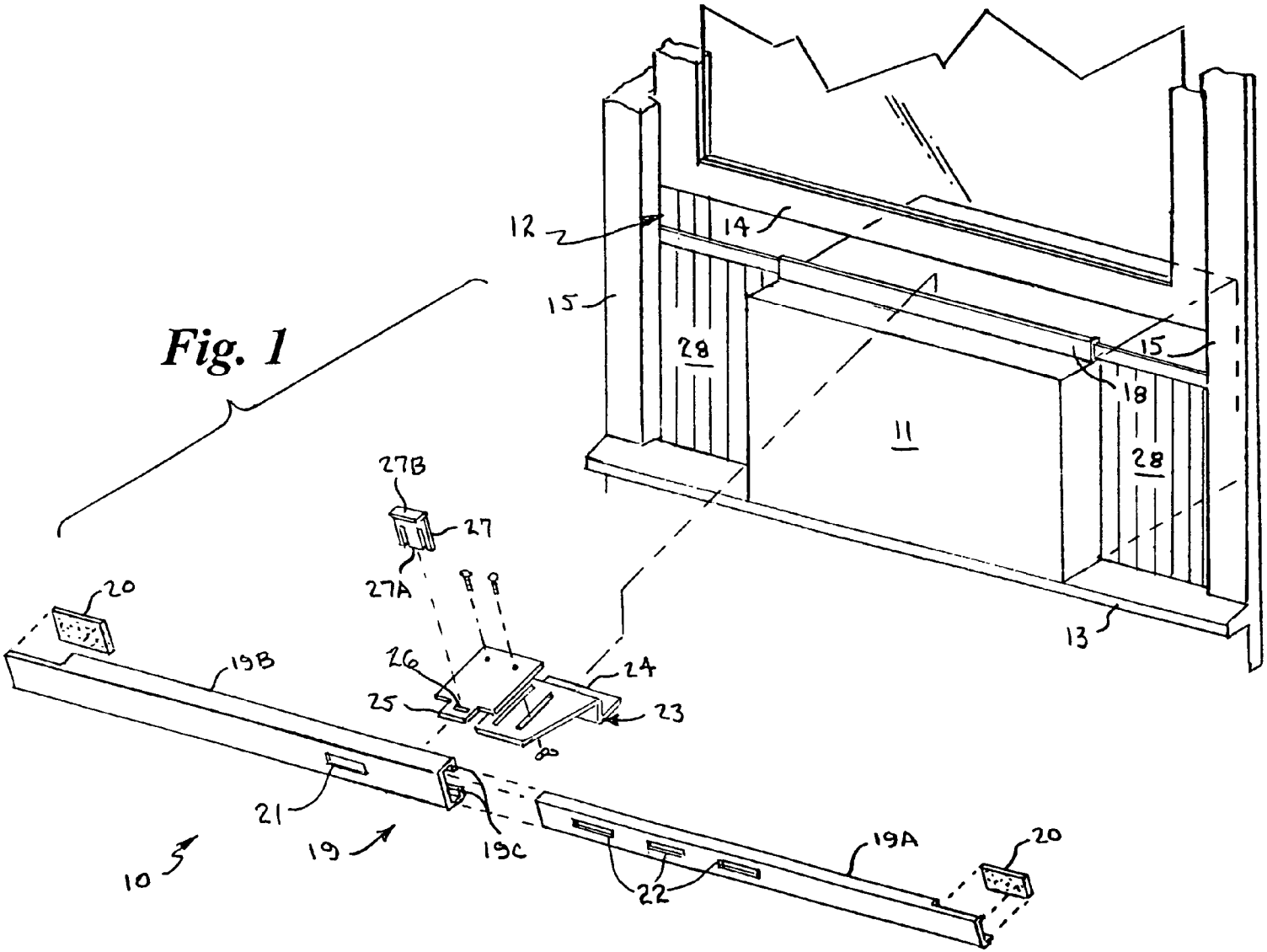
FIG. 1 is an exploded perspective view of the quick release mounting components for mounting room air conditioners in accordance with the present invention.
Figure 2:
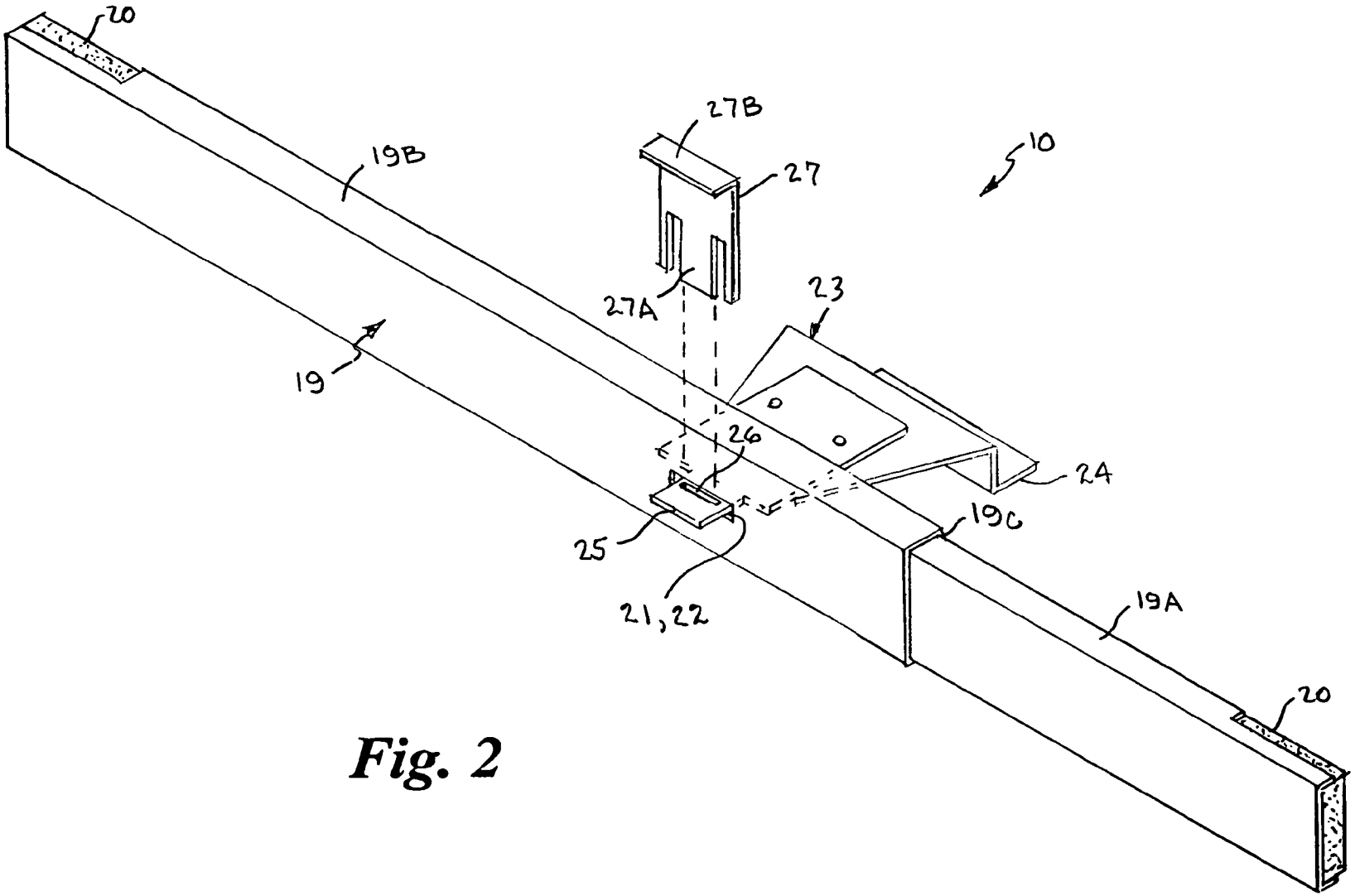
FIG. 2 is an isometric view of the quick release mounting components shown in the assembled condition.
Figure 3:
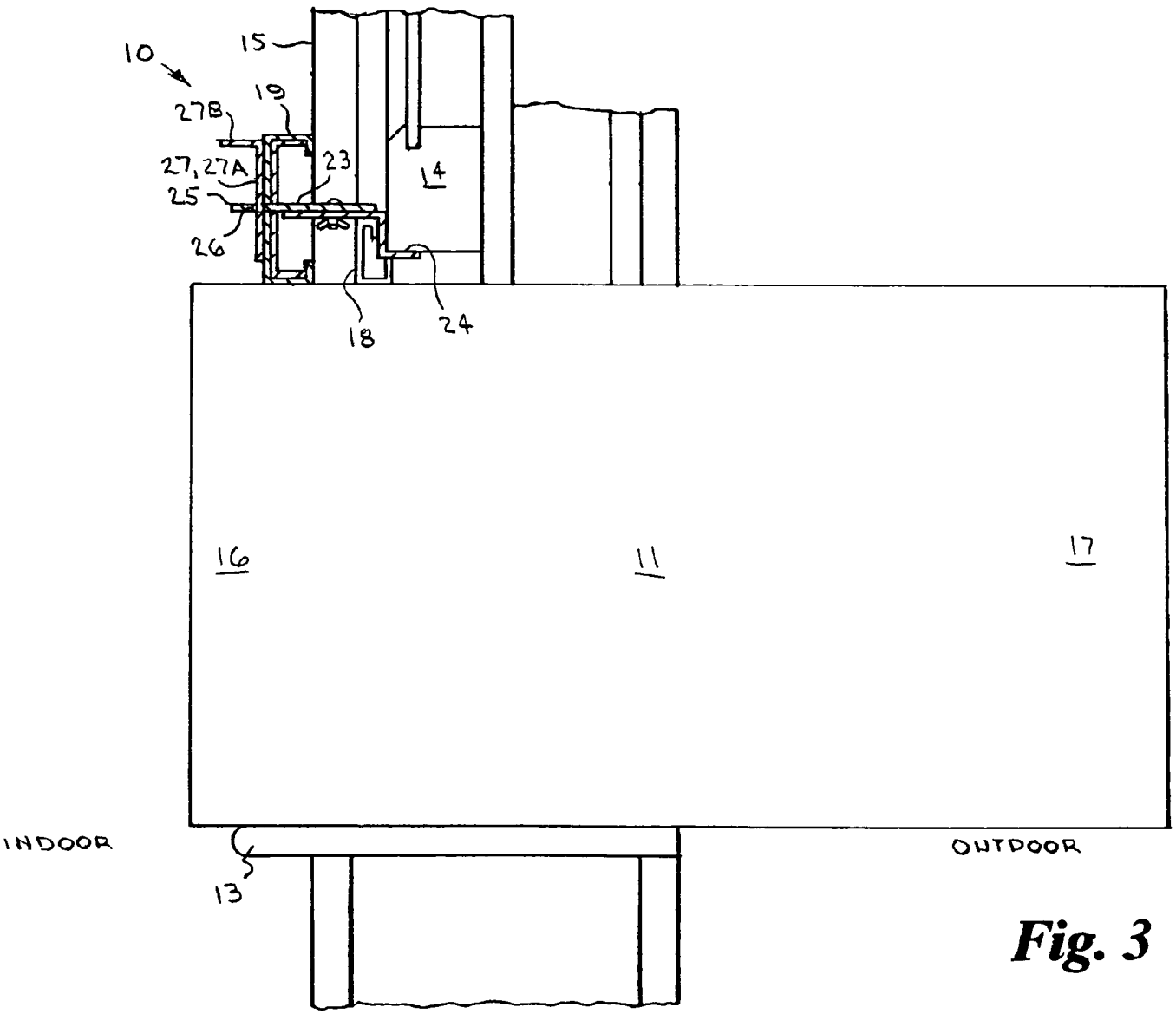
FIG. 3 is a side cross sectional view showing, somewhat schematically, the air conditioning unit and quick release mounting in the installed and latched condition in a window opening.

Referring now to FIGS. 1, 2 and 3 of the drawings by numerals of reference, the quick release mounting in accordance with the present invention is shown generally at 10 as applied to a conventional room air conditioning unit 11 mounted in a window opening 12 bordered by a window sill 13 at the bottom, the window sash 14 at the top, and laterally opposed vertical side members 15. In some window installations, the lateral sides of the window opening 12 on the interior of the building is bordered by conventional sheetrock and wall construction rather than having vertical frame members. It should be understood, that the terms "vertical side members" and "vertical sides of the window opening" are meant to encompass both window installations having vertical frame members and installations having conventional sheetrock and wall construction at the lateral sides of the window opening.

The type, size, and shape of the air conditioning unit 11, or its outer casing, can be varied while remaining within the scope of the present invention. Generally, the air conditioning unit 11 includes an indoor portion 16, which is disposed in the interior of the building, and an outdoor portion 17, which is disposed exterior of the building. The casing or housing of the conventional air conditioning unit 11 typically has a channel with an upstanding lip 18 that extends transversely across the top surface of the cabinet near its front end and behind which the sash 14 of the window is received when it is lowered. This channel is also commonly referred to as a guide rail, top rail, or a top mounting rail, and will be referred to hereinafter as the "guide rail".

The present quick release mounting 10 includes an elongate support crossbar 19 adapted to transversely span the distance between the vertical side members 15 of the window opening on the interior of the building with each end engaged on the vertical side members of the window frame or the wall construction at the lateral sides of the window opening. In a preferred embodiment, the crossbar 19 is formed of an inner generally C-shaped channel 19A and an outer generally C-shaped channel 19B, which are slidably joined together in telescoping relation. Preferably, the outer C-shaped channel 19B has vertically spaced longitudinal lips 19C at the open side of the C-shape. The outer ends of each channel 19A and 19B are provided with a resilient pad 20. One of the channels is provided with a central longitudinal slot 21 and the other is provided with a series of axially aligned smaller longitudinal slots 22. Alternatively the crossbar 19 may be of unitary construction provided in sizes to transversely span the distance between the vertical side members of standard window opening sizes, and provided with a single central longitudinal slot.

A generally flat securing bracket 23 is slidably received through the aligned slots 21, 22, or slot in the crossbar 19 and has a generally L-shaped rear end 24 configured to overhang the upstanding lip 18 of the guide rail extending transversely across the upper surface of the air conditioning unit 11 and receive the window sash 14, and has a flat planar tongue portion 25 at a front end that protrudes from the front of the crossbar with a slot 26 extending therethrough. In a preferred embodiment, the securing bracket 23 is of two-piece plate construction whereby the relative distance between the slot 26 and the L-shaped rear end 24 can be adjusted and then the two pieces secured to accommodate various horizontal distances of the particular window frame and air conditioning unit installation.

A quick release latch member 27 having a tang portion 27A is installed through the slot 26 in the tongue portion 25 of the bracket 23 to releasably hold the bracket in place and prevent the tongue portion from accidentally sliding rearwardly from the crossbar 19. The quick release latch member 27 has a grip portion 27B to facilitate gripping by the user for manipulating the latch during the installation and removal operations described below.

Figure 4:
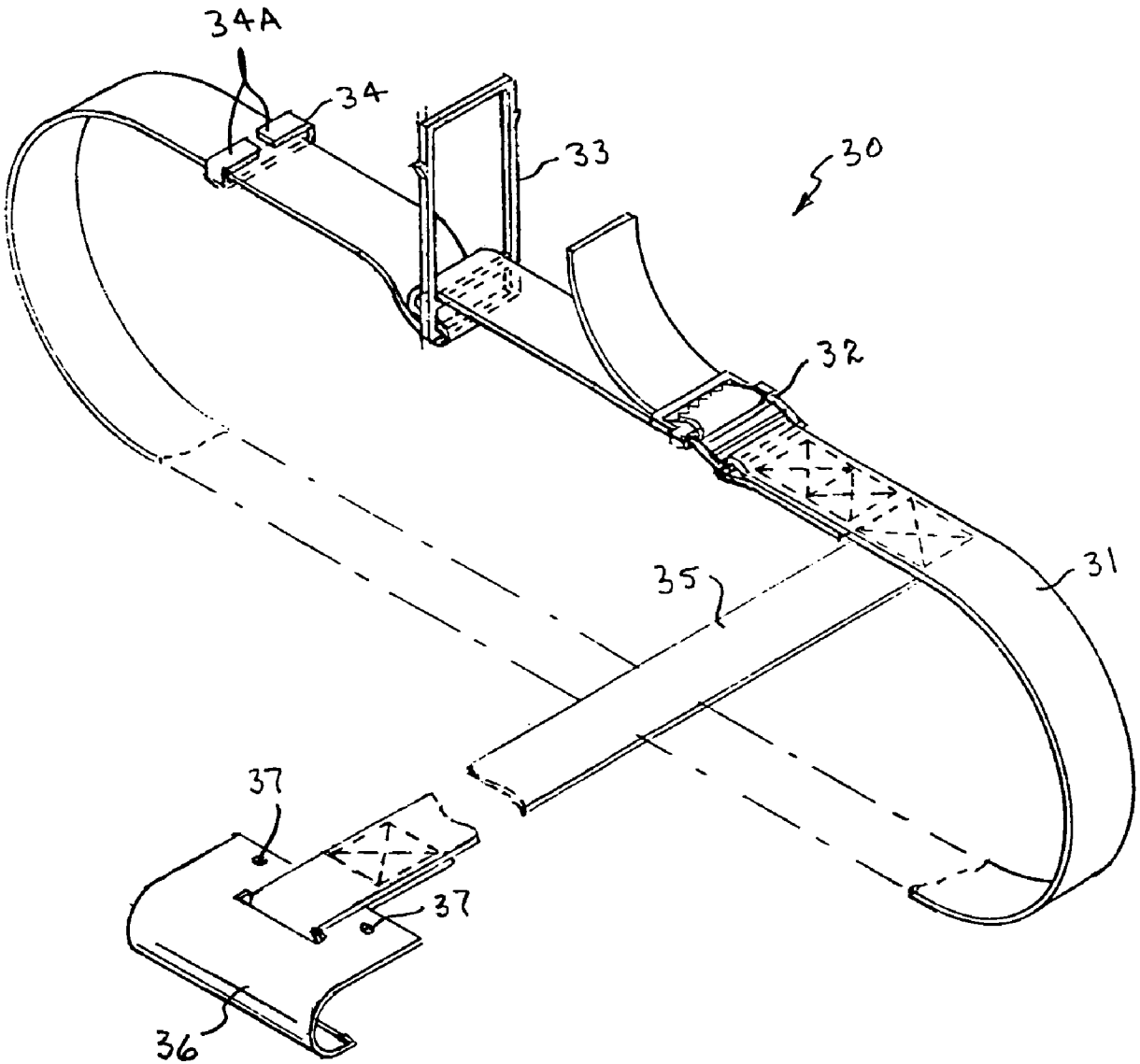
FIG. 4 is an isometric view of the safety harness that may be used to prevent the air conditioning unit from falling to the ground.
Figure 5:
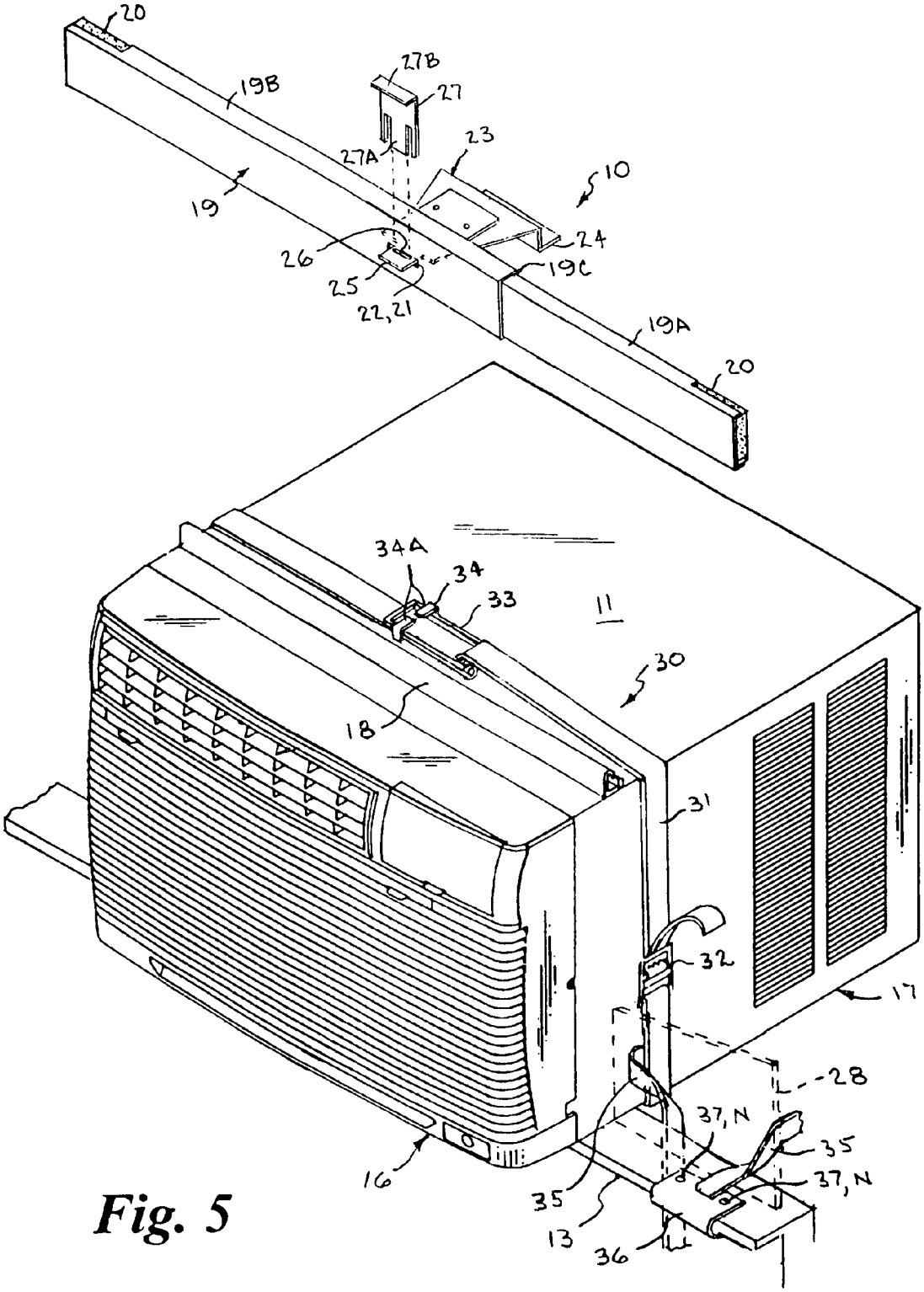
FIG. 5 is an isometric view of the safety harness installed on the air conditioning unit.

As shown in FIGS. 4 and 5, a safety harness 30 may be provided for use in some installations to prevent the air conditioning unit 11 from falling to the ground and tether it to the window frame structure a distance above the ground on the exterior of the building after it has been released by the quick release latch member 27 (as described hereinafter). The safety harness 30 includes a belt 31 formed of webbing material having a jaw-type gripping buckle 32 at one end, an over-the-center tensioning lever device 33 having an aperture at one end through which the belt is looped, and a generally rectangular C-shaped retaining clip 34 slidably mounted thereon sized to slide over the other end of the lever device when it is superposed on the belt in a horizontal position. A tether strap 35 formed of webbing material is secured at one end to the belt 31 and has a generally flat J-shaped hook member 36 secured at its other end. The J-shaped hook member 36 may be provided with one or more small holes 37 for receiving a nail or tack.

It should be understood that the buckle 32, tensioning lever 33, and retaining clip of the belt member 31 of the safety harness 30 may be replaced by a tensioning type lever ratchet mechanism which is conventional and well known in the in the art and therefore not shown or described in detail.

Having described the structural components of the quick release room air conditioner mounting apparatus, the method of installation and operation will now be described.

The conventional air conditioning unit 11 is supported on the window sill 13 with the crossbar 19 supported transversely on or above its top surface with the pads 20 at the outer ends of each channel 19A and 19B disposed on the interior facing surfaces of the lateral sides or lateral side members of the window opening. The L-shaped end 24 of the securing bracket 23 is placed over the upstanding lip 18 of the guide rail on the upper surface of the air conditioning unit, and the tongue portion 25 of the bracket is installed through the aligned slots 21, 22, in the crossbar with the slot 26 of the tongue portion 25 closely adjacent to the front surface of the crossbar 19. The window sash 14 is brought down on the L-shaped end 24 of the securing bracket 23 to firmly engage the bracket over the upstanding guide rail lip 18 on the upper surface of the air conditioning unit. The tang 27A of the latch member 27 is then installed through the slot 26 in the tongue 25 of the bracket 23 to secure the unit in its installed position. Size adjustable side curtains or filler panels 28 may be used at the sides of the unit to accommodate the various sizes of window openings, and suitable conventional weather seals may be installed around the unit. The weather seals are conventional and not shown in the drawings to avoid confusion.

The heavier outdoor portion 17 of the air conditioning unit 11 is exterior of the building in heat exchange relation with the outdoor air, and the lighter weight indoor portion 16 is in heat exchange relation with the indoor air. The air conditioning unit 11 is held in its installed position with its heavier weight outdoor portion 17 cantilevered exterior of the building forming a rearward moment arm or rotational force that biases the crossbar 19 (and pads 20) into engagement with the vertical side members 15 of the window frame or on the wall construction at the lateral sides of the window opening on the interior of the building to support the weight of the unit. Unlike conventional room air conditioner mounting techniques, the present mounting supports the weight of the unit from the interior of the building rather than supporting it exterior of the building on various types of supporting shelves, brackets, clamps, and the like. In the latched condition, the present mounting allows the window to be raised and lowered.

In the event of an emergency, such as a fire, the occupant unplugs the power cord of the air conditioning unit and simply raises the window and withdraws the quick release latch member 27 from the tongue 25 of the bracket 23. This causes the cantilevered weight of the air conditioning unit to pull the securing bracket 23 rearwardly from the crossbar 19 thereby relieving the force holding the crossbar against the window frame members or the wall construction at the lateral sides of the window opening. The air conditioning unit will then topple rearwardly out of the window opening exterior of the building, and the occupant(s) can then easily and quickly escape through the open window.

The safety harness 30 may be used in ground floor installations or in installations above the ground floor to prevent the air conditioning unit 11 from falling to the ground and tether it to the window frame structure a distance above the ground on the exterior of the building after it has been released by the quick release latch member 27 (as described above).

The safety harness 30 is installed on the air conditioning unit 11 by wrapping the belt 31 around the outdoor portion 17 of the unit directly behind the upstanding guide rail 18 on the top of the unit with the tether strap 35 and its J-shaped hook 36 facing the window opening. The tether strap 35 should be positioned with its connection to the belt 31 disposed near the bottom of one side of the air conditioning unit 11 and its outer end extending from the unit toward one of the side curtains or filler panels 28.

The free end of the belt 31 is threaded through the buckle 32 and tightened, and then the over-the-center tensioning lever device 33 is pivoted to a horizontal position superposed on the belt to apply additional tension to the belt. When properly installed, the belt 31 should be extremely tight without warping the housing of the air conditioning unit. After the belt is properly tightened, the retaining clip 34 is slid over the end of the lever device 33 in its superposed horizontal position on the belt. One or both of the opposed ends 34A of the C-shaped retaining clip 34 can be manually bent down to lock the lever device 33 in its superposed position and prevent accidental removal of the clip.

The tether strap 35 is passed around the outer side of one of the adjustable side curtains or filler panels 28 and the J-shaped hook 36 is hooked over the front of the window sill 13. The J-shaped hook 36 may then be secured to the window sill 13 by driving a tack or nail N through the holes 37 and into window sill to prevent accidental removal.

When the safety harness 30 is used, and the release latch member 27 is withdrawn from the tongue 25 of the bracket 23, the air conditioning unit 11 is released and topples rearwardly from the window opening but is prevented from falling to the ground. Instead, it is suspended a distance above the ground on the exterior of the building and remains tethered to the window frame structure, but allows occupants to easily and quickly escape through the open window.

The preferred embodiment has been shown and described, for purposes of example, as being used in conjunction with a vertical lift window, however, it should be understood that because the crossbar spans the window opening and supports the weight of the air conditioner from the sides of the window opening, the present apparatus may also be used in conjunction with horizontally sliding windows.

Although the present invention has been described fully and completely with special emphasis upon preferred embodiments, it should be understood that within the scope of the appended claims the invention may be practiced otherwise than as specifically described herein.

The invention claimed is:

1. The combination of a quick release mounting apparatus, an air conditioner and a window opening, the quick release mounting apparatus holding the room air conditioner unit, in the window opening of a room having an interior, in a cantilevered condition and releasing it therefrom in an emergency, the window opening bordered by vertical surfaces at laterally opposed sides, a window sill at the bottom, and a window sash of a sliding window, the air conditioner unit having an indoor portion resting on the window sill, an outdoor portion disposed exterior of the room and an upstanding guide rail extending across a top surface, the mounting apparatus comprising:

a crossbar transversely spanning the window opening, having opposed outer ends removably engaging the vertical surfaces at laterally opposed sides of the window opening on the interior of the room and an aperture formed therethrough intermediate said opposed ends;

a bracket member having a rear portion engaging the upstanding guide rail of the air conditioner unit, and a tongue portion extending slidably through said aperture in said crossbar, said tongue portion having a slot near an outer end; and a removable latch member having a tang portion received through said slot in said tongue portion for releasably holding said bracket in place on the upstanding guide rail in a latched condition, and removable from said slot in an unlatched condition for allowing withdrawal of said bracket tongue portion from said crossbar aperture and disengagement of said bracket from the guide rail in an unlatched condition; in the latched condition, said crossbar, said bracket, and said latch member holding the indoor portion of the room air conditioner unit resting on the window sill with its outdoor portion disposed outside the room in a cantilevered condition such that the weight of the outdoor portion of the room air conditioner unit creates a rearward moment arm or rotational force that biases said crossbar into engagement on the vertical surfaces at the sides of the window opening to hold the air conditioner unit in the cantilevered condition in the window opening; and in the unlatched condition, upon opening the window and removing said latch member tang portion from said bracket tongue portion slot to allow withdrawal of said bracket tongue portion from said crossbar aperture, the rearward moment arm or rotational force that biases said crossbar into engagement on the vertical surfaces at the sides of the window opening is removed the crossbar falls away from the window opening, and the air conditioner unit topples rearwardly from the window opening exterior of the room to provide an escape route through the open window.

2. The combination according to claim 1, further comprising;

tethering means having a first end secured to the air conditioner unit and a second end secured to the window opening for suspending the air conditioner unit a distance above the ground on the exterior of the room after it topples rearwardly from the window opening to prevent it from falling to the ground and provide an unobstructed escape route through the open window.

3. A method for releasably holding a room air conditioner in a window opening in a room of a building with an indoor portion of the air conditioner resting on the window sill and an outdoor portion of the air conditioner disposed exterior of the room in a cantilevered condition and quickly releasing it the window opening in the event of an emergency to provide an escape route through the window opening, comprising the steps of:

providing quick release mounting apparatus including a crossbar having opposed outer ends adapted to removably engage vertical surfaces at laterally opposed sides of the window opening on the interior of the room, and an aperture formed through said crossbar intermediate said opposed ends, a bracket member having a rear portion adapted to engage an upstanding guide rail of the air conditioner unit, and a tongue portion extending slidably through said aperture in said crossbar, said tongue portion having a slot near an outer end, and a removable latch member having a tang portion adapted to be received through said slot in said tongue portion for releasably holding said bracket in place on the upstanding guide rail in a latched condition, and removable from said slot in an unlatched condition for allowing withdrawal of said bracket tongue portion from said crossbar aperture and disengagement of said bracket from the guide rail in an unlatched condition;

placing the room air conditioner unit on a window sill at the bottom of the window opening with its indoor portion resting on the window sill and its outdoor portion disposed outside the room in a cantilevered condition;

placing said crossbar on a top surface of the indoor portion of the air conditioner to transversely span the window opening with its said opposed outer ends disposed on vertical surfaces at laterally opposed sides of the window opening on the interior of the room;

engaging said bracket member on the upstanding guide rail of the air conditioner unit and sliding said tongue portion through said aperture in said crossbar; and installing said removable latch tang portion through said slot in said tongue portion to releasably connect said bracket with said crossbar and hold said bracket engaged on the upstanding guide rail such that the weight of the outdoor portion of the air conditioner creates a rearward moment arm or rotational force that biases said crossbar outer ends into engagement on the vertical surfaces at the sides of the window opening to hold the air conditioner unit in the cantilevered condition; and in the event of an emergency, raising the window and removing said latch member tang portion from said bracket tongue portion slot to allow withdrawal of said bracket tongue portion from said crossbar aperture, such that the rearward moment arm or rotational force that biases said crossbar into engagement on the vertical surfaces at the sides of the window opening is removed, said crossbar falls away from the window opening and the air conditioner unit topples rearwardly from the window opening exterior of the room to provide an escape route through the open window.

4. The method according to claim 3, wherein said step of placing the room air conditioner unit on a window sill at the bottom of the window opening includes the step of securing a first end of a tether to the air conditioner unit and securing a second end of said tether to the window opening to suspend it a distance above the ground on the exterior of the room after it topples rearwardly from the window opening to prevent it from falling to the ground and provide an unobstructed escape route through the open window.

* * * * *